US009127875B2

(12) United States Patent
Hall

(10) Patent No.: US 9,127,875 B2
(45) Date of Patent: Sep. 8, 2015

(54) VARIABLE POWER DEFROST HEATER

(75) Inventor: David L. Hall, Piedmont, SC (US)

(73) Assignee: ELECTROLUX HOME PRODUCTS, INC., Cleveland, OH (US)

( * ) Notice: Subject to any disclaimer, the term of this patent is extended or adjusted under 35 U.S.C. 154(b) by 665 days.

(21) Appl. No.: 13/022,165

(22) Filed: Feb. 7, 2011

(65) Prior Publication Data

US 2012/0198863 A1 Aug. 9, 2012

(51) Int. Cl.
*F25D 21/00* (2006.01)
*F25D 21/08* (2006.01)

(52) U.S. Cl.
CPC ..... *F25D 21/006* (2013.01); *F25D 21/08* (2013.01); *F25B 2700/11* (2013.01); *F25B 2700/2117* (2013.01)

(58) Field of Classification Search
CPC ... F25D 21/08; F25D 21/006; F25B 2700/11; F25B 2700/2117
USPC ..... 62/126, 234, 139, 140, 151, 156, 80, 62/154
See application file for complete search history.

(56) References Cited

U.S. PATENT DOCUMENTS

| | | | | |
|---|---|---|---|---|
| 4,432,211 | A | 2/1984 | Oishi et al. | |
| 4,573,326 | A | 3/1986 | Sulfstede et al. | |
| 4,993,233 | A | 2/1991 | Borton et al. | |
| 5,388,421 | A * | 2/1995 | Matsuoka | 62/209 |
| 5,787,723 | A * | 8/1998 | Mueller et al. | 62/347 |
| 5,950,439 | A | 9/1999 | Peterson et al. | |
| 6,467,282 | B1 * | 10/2002 | French et al. | 62/140 |
| 6,606,870 | B2 | 8/2003 | Holmes et al. | |
| 6,631,620 | B2 * | 10/2003 | Gray et al. | 62/156 |
| 6,725,680 | B1 * | 4/2004 | Schenk et al. | 62/186 |
| 6,964,172 | B2 | 11/2005 | Dudley et al. | |
| 7,275,376 | B2 | 10/2007 | Swofford | |
| 2006/0232907 | A1 * | 10/2006 | Huber et al. | 361/160 |
| 2007/0234748 | A1 * | 10/2007 | Alvord et al. | 62/150 |

(Continued)

FOREIGN PATENT DOCUMENTS

| | | | |
|---|---|---|---|
| DE | 2557794 | | 6/1977 |
| JP | 2005180838 | A * | 7/2005 |

(Continued)

OTHER PUBLICATIONS

International Search Report for PCT/US2012/022056, dated Oct. 19, 2012, 2 pages.

*Primary Examiner* — Cheryl J Tyler
*Assistant Examiner* — Ana Vazquez
(74) *Attorney, Agent, or Firm* — Pearne & Gordon LLP

(57) ABSTRACT

A refrigeration appliance includes a storage compartment. An evaporator cools the storage compartment. A defrost heater is associated with the evaporator. A temperature sensor senses an evaporator temperature and generates a temperature signal based on the evaporator temperature. A controller receives the temperature signal and generates a defrost heater power control signal. A power supply receives the defrost heater power control signal and controls a power level supplied to the defrost heater based on the defrost heater power control signal. A first power level is supplied to the defrost heater during a first heating interval of a defrosting operation, and, based on an evaporator temperature rise occurring during the first heating interval, the controller adjusts the defrost heater power control signal such that an adjusted power level is supplied to the defrost heater during a second heating interval of the defrosting operation.

16 Claims, 3 Drawing Sheets

(56) References Cited

U.S. PATENT DOCUMENTS

| | | | | |
|---|---|---|---|---|
| 2009/0001866 | A1* | 1/2009 | Kaga et al. | 312/401 |
| 2012/0042667 | A1* | 2/2012 | Fulmer et al. | 62/80 |

FOREIGN PATENT DOCUMENTS

| | | |
|---|---|---|
| WO | 2008109927 | 9/2008 |
| WO | 2010107536 | 9/2010 |

* cited by examiner

VARIABLE POWER DEFROST HEATER

BACKGROUND OF THE INVENTION

1. Field of the Invention

The present invention relates generally to a refrigeration appliance, and more specifically to the control of a defrost heater for defrosting an evaporator of the refrigeration appliance.

2. Description of Related Art

It is known to provide a defrost heater for defrosting an evaporator of a refrigeration appliance, such as a domestic refrigerator or freezer. In conventional arrangements, a defrosting operation is periodically initiated by a timer. The defrost heater is activated during the defrosting operation and consumes a fixed power level when activated. The defrosting operation ends when the evaporator reaches a predetermined temperature.

BRIEF SUMMARY OF THE INVENTION

A problem associated with conventional defrosting arrangements is that they do not adequately account for differences in the amount of ice that can accumulate on the evaporator between defrosting operations. For example, some conventional arrangements modify the period between defrosting cycles based on the time required to complete the last defrosting operation. This backward-looking approach may not properly address the current condition of the evaporator, which may have more or less accumulated ice than during the previous defrosting operation.

Therefore, in accordance with one aspect of the present invention, provided is a refrigeration appliance comprising a storage compartment. An evaporator cools the storage compartment. A defrost heater is associated with the evaporator. A temperature sensor senses an evaporator temperature and generates a temperature signal based on the evaporator temperature. A controller receives the temperature signal and generates a defrost heater power control signal. A power supply receives the defrost heater power control signal and controls a power level supplied to the defrost heater based on the defrost heater power control signal. A first power level is supplied to the defrost heater during a first heating interval of a defrosting operation, and, based on an evaporator temperature rise occurring during the first heating interval, the controller adjusts the defrost heater power control signal such that an adjusted power level is supplied to the defrost heater during a second heating interval of the defrosting operation.

In accordance with another aspect of the present invention, provided is a method of defrosting an evaporator of a refrigeration appliance comprising a defrost heater associated with the evaporator. The method includes energizing the defrost heater at a first power level. An evaporator temperature is monitored during a first heating interval of a defrosting operation. A rate of evaporator temperature rise occurring during the first heating interval is determined A target rate of temperature rise for the first heating interval is provided. The rate of evaporator temperature rise during the first heating interval is compared to the target rate of temperature rise for the first heating interval. Based on a result of the step of comparing, the first power level is adjusted to an adjusted power level and the defrost heater is operated at the adjusted power level during a second heating interval of the defrosting operation.

DETAILED DESCRIPTION OF THE INVENTION

Figure 1:
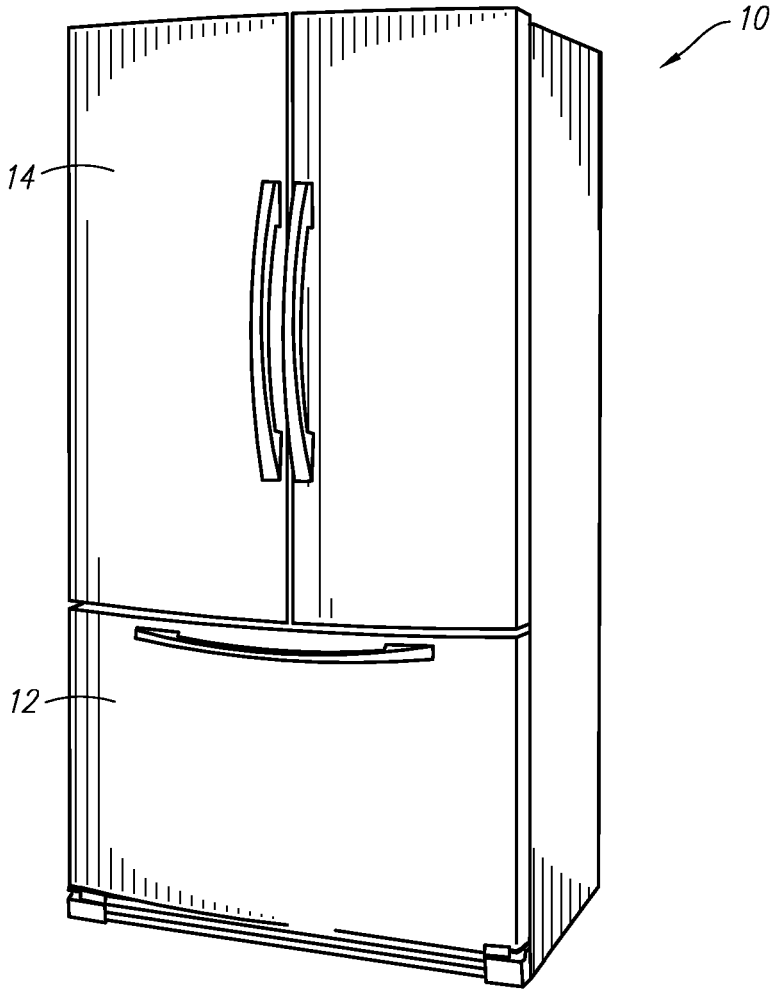
FIG. 1 is a perspective view of a refrigerator.

The present invention will now be described with reference to the drawings, wherein like reference numerals are used to refer to like elements throughout. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

Referring to FIG. 1 there is illustrated a refrigeration appliance in the form of a domestic refrigerator, indicated generally at 10. Although the following detailed description of an embodiment of the present invention concerns a domestic refrigerator 10, the invention can be embodied by refrigeration appliances other than a domestic refrigerator 10, such as a chest freezer for example. Further, the embodiment is shown in the figures as a "bottom-mount" refrigerator 10 with a freezer compartment 12 located beneath a fresh-food compartment 14. However, it is to be appreciated that the refrigerator 10 can have other configurations, such as "top-mount" and "side-by-side" configurations.

Figure 2:
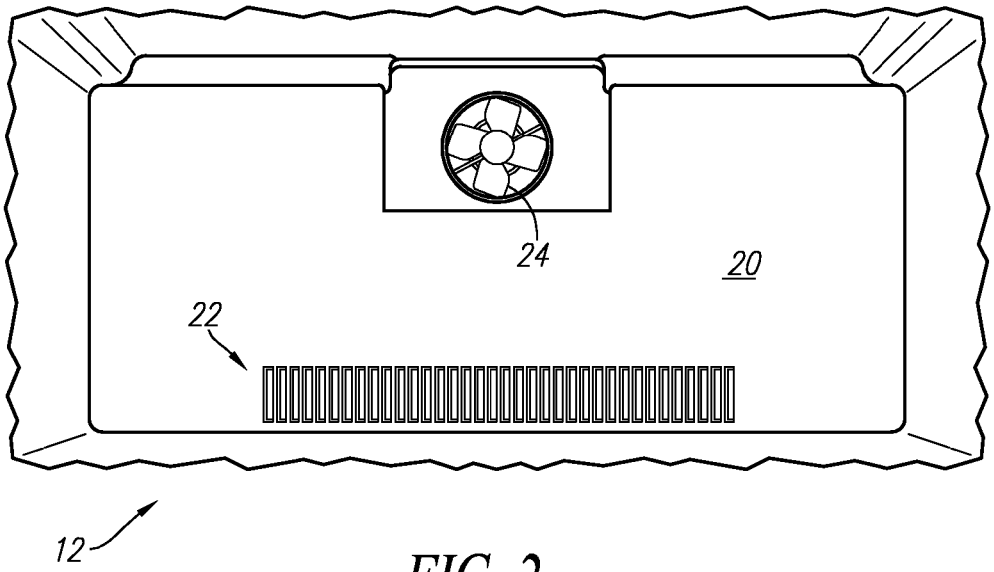
FIG. 2 is a perspective view of an evaporator assembly.

As is known in the art, a refrigeration circuit including a compressor, a condenser, and an evaporator cools a storage compartment (e.g., the freezer and/or fresh-food compartment) of the refrigerator. FIG. 2 is a perspective view of an example evaporator assembly that can be located within the refrigerator 10, such as within the freezer compartment 12, for cooling the freezer compartment and/or the fresh-food compartment. It is to be appreciated that the evaporator assembly could be located in the fresh-food compartment 14, and further that the freezer and fresh-food compartments could have separate, dedicated evaporator assemblies.

The evaporator is located behind a panel 20 and, therefore, is not shown in FIG. 2. Via a vent 22, a fan 24 moves air from the freezer compartment across the evaporator to cool the air, and discharges the cooled air back into the freezer compartment.

Figure 3:
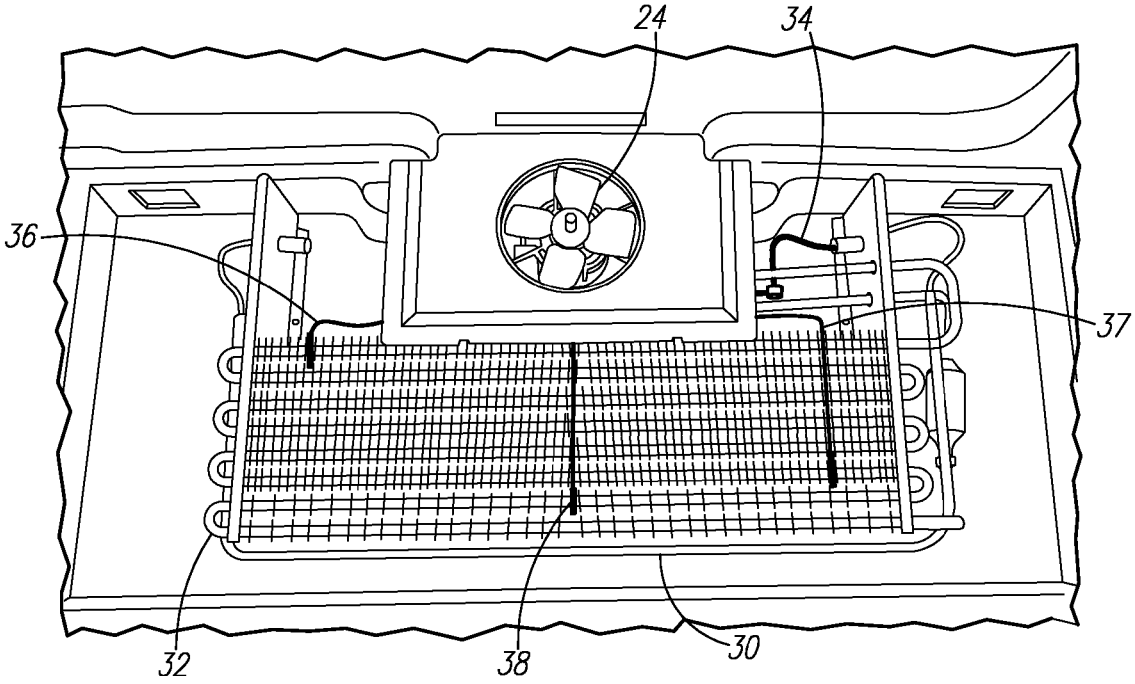
FIG. 3 is a perspective view of an evaporator assembly.

FIG. 3 is a perspective view of the evaporator assembly with the panel 20 removed. A defrost heater 30 is mounted near the evaporator 32 for removing ice from the evaporator. The defrost heater 30 shown in FIG. 3 surrounds the evaporator 32 on three sides. However, the defrost heater 30 could be mounted in other positions relative to the evaporator 32, such as behind the evaporator, directly on the evaporator, etc.

In an embodiment, the defrost heater 30 comprises an electric resistance heating element, such as a tubular heating element (e.g., a CALROD element). A cable 34 supplies electrical power from the refrigerator to the defrost heater 30. The defrost heater 30 has a rated power (e.g., 450 watts) when operated at its rated voltage (e.g., 115 VAC).

The defrost heater 30 is operated periodically, such as every 8 hours, every 10 hours, etc. to defrost the evaporator 32. The defrost heater can be operated periodically with a fixed period between defrosting cycles that does not change. Alternatively, the defrost heater can be operated according to an "adaptive defrost" scheme in which the period between defrosting cycles is dynamically changed by a controller based on the time required to complete the last defrosting operation. The defrost heater could further be operated based on sensing a build-up of ice on the evaporator 32.

Temperature sensors 36, 37, 38 (e.g., thermocouple, RTD, etc.) are located on or near the evaporator 32 for sensing the temperature of the evaporator. The temperature sensors 36, 37, 38 generate respective temperature signals based on the evaporator temperature. Although three temperature sensors 36, 37, 38 are shown in FIG. 3, it is to be appreciated that any number of temperature sensors can be used as desired, such as one temperature sensor, two temperature sensors, four temperature sensors, etc. The evaporator 32 can have various "cold spots" that are the last spots on the evaporator to be defrosted, and it might be desirable to locate temperature sensors at such cold spots to help determine when the evaporator is completely defrosted.

Figure 4:
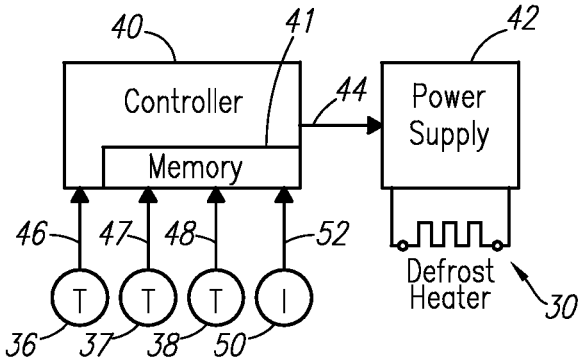
FIG. 4 is a schematic block diagram defrost system.

A schematic block diagram of the defrost system is provided in FIG. 4. A controller 40 controls the operation of a power supply 42, which in turn controls the electrical power supplied to the defrost heater 30. By controlling the operation of the power supply 42, the controller 40 controls the power level supplied to the defrost heater 30.

The controller 40 can be an electronic controller and may include a processor. The controller 40 can include one or more of a microprocessor, a microcontroller, a digital signal processor (DSP), an application specific integrated circuit (ASIC), a field-programmable gate array (FPGA), discrete logic circuitry, or the like. The controller 40 can further include memory 41 and may store program instructions that cause the controller to provide the functionality ascribed to it herein. The memory may include one or more volatile, non-volatile, magnetic, optical, or electrical media, such as read-only memory (ROM), random access memory (RAM), electrically-erasable programmable ROM (EEPROM), flash memory, or the like. The controller 40 can further include one or more analog-to-digital (A/D) converters for processing various analog inputs to the controller. The controller 40 can be a dedicated controller that is used substantially only for controlling the defrosting operation, or the controller 40 can control a plurality of functions commonly associated with a refrigeration appliance, such as activating the compressor and the condenser fan, controlling temperature, and the like.

The power supply 42 controls the power level supplied to/consumed by the defrost heater 30. The power supply 42 can control one or both of the voltage level supplied to the defrost heater 30 and the current level supplied to the defrost heater. Various types of power supplies could be used in the present invention, such as pulse-width modulated (PWM) power supplies and controllable switches (e.g., transistor, triac, SCR, etc.) for controlling the voltage level supplied to the defrost heater 30. The present invention, therefore, is not limited to a particular type of power supply.

The power supply 42 receives a defrost heater power control signal 44 from the controller 40. The power supply 42 controls the power level supplied to the defrost heater 30 based on the control signal. The defrost heater power control signal 44 can be an analog signal or a digital signal, depending on the requirements of the power supply 42.

The controller 40 receives the respective temperature signals 46, 47, 48 from the temperature sensors 36, 37, 38 as inputs. In the manner described below, the controller 40 controls the operation of a power supply 42, to thereby control the power level supplied to the defrost heater 30, based on one or more of the temperature signals 46, 47, 48. The defrost system can further include an ice detector 50, such as a capacitive ice detector, a mechanical arm ice detector, etc., for initiating and/or terminating the defrosting operation. The ice detector 50 generates an ice detection signal 52, which is an input to the controller 40.

Figure 5:
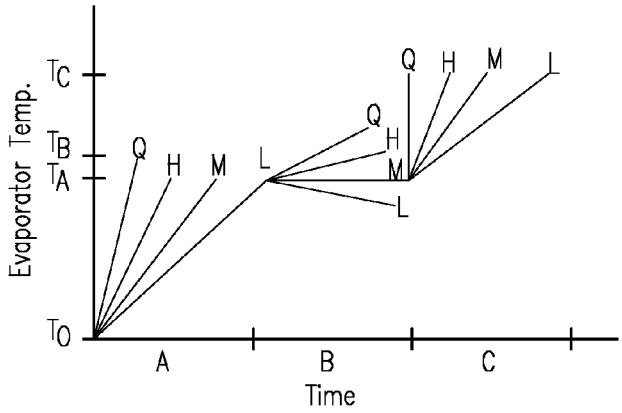
FIG. 5 is a graph of heating curves.

The defrost system controls a defrosting operation in a series of heating intervals. FIG. 5 shows three intervals A, B and C, however fewer or additional intervals are possible. One or more of the intervals (e.g., interval B) can correspond to a melting temperature wherein the ice on the evaporator 32 substantially changes from a solid to a liquid state. The curves L, M, H, Q are evaporator heating curves, which can vary from defrosting operation to defrosting operation depending on the amount of accumulated ice on the evaporator. The L curve shows evaporator heating that occurs when low power (e.g., 50% rated voltage or 25% rated power) is applied to the defrost heater 30. The M curve shows evaporator heating that occurs when medium power (e.g., 71% rated voltage or 50% rated power) is applied to the defrost heater 30. The H curve shows evaporator heating that occurs when high power (e.g., 100% rated voltage or 100% rated power) is applied to the defrost heater 30. The Q curve shows evaporator heating that occurs when greater than rated power (e.g., 112% rated voltage or 125% rated power) is applied to the defrost heater 30.

During interval A, the temperature of the evaporator 32 and any attached ice rises toward the melting point of the ice. Ice melting occurs during interval B, and, there can be little or no temperature rise during interval B. During interval C, the temperature of the evaporator 32 rises toward a final temperature at which the defrosting operation is stopped.

As will be explained below, the controller 40 can adjust the power level that is supplied to the defrost heater 30 during the defrosting operation, so that a desired heating curve slope or duration of the defrosting operation is achieved. Initially, a target rate of temperature rise is determined for the evaporator and stored in the memory 41 associated with the controller 40. The target rate of temperature rise can be experimentally determined, calculated, etc. For example, it may be desirable to gradually raise the temperature of the evaporator to avoid dislodging large chunks of ice. The appropriate rate of temperature rise can be predetermined experimentally, and different appliances and applications can have different target rates of temperature rise. The target rate of temperature rise can be, for example, a target temperature slope, or a target amount of temperature rise for a fixed amount of time (e.g., a target temperature at the end of a heating interval), or a target amount of time for a fixed amount of temperature rise. The controller 40 tries to cause the evaporator 32 to be heated at the target rate of temperature rise during the defrosting operation. Different target rates can be provided for the different heating intervals A, B, C.

Figure 6:
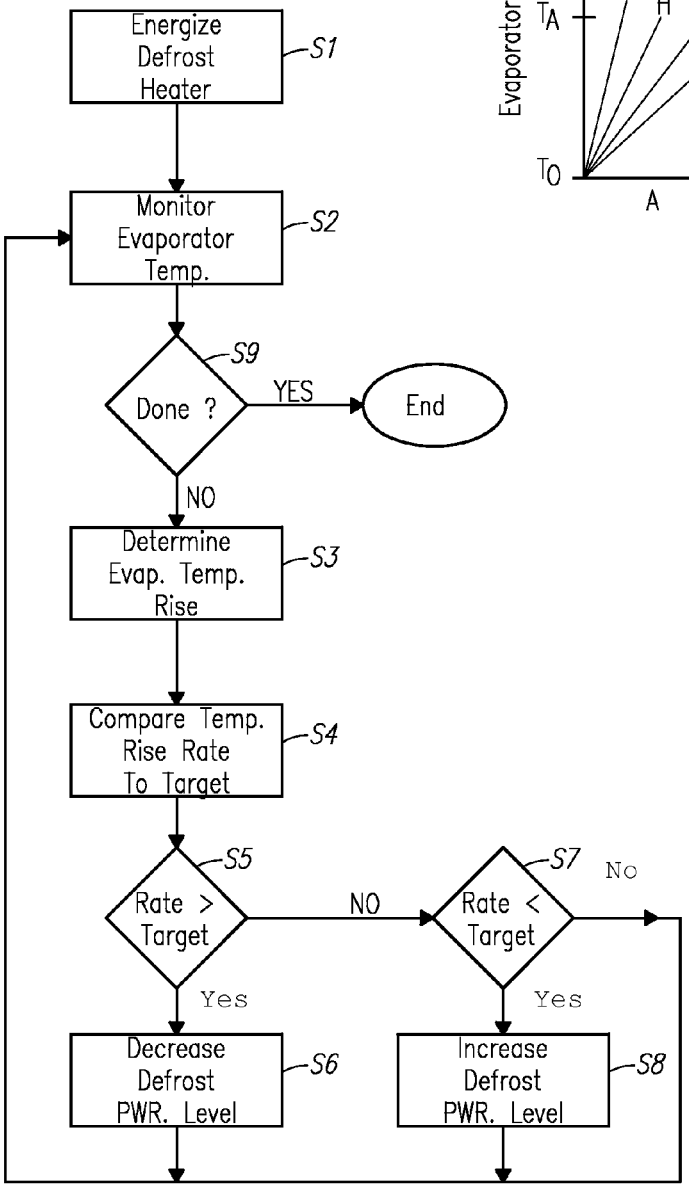
FIG. 6 is a flowchart.

When the defrosting operation begins, the controller 40 supplies an initial defrost heater power control signal 44 to the power supply 42. The initial defrost heater power control signal can correspond to a default power level, such as 50%. Alternatively, historical information from a previous defrosting operation, measurements concerning the amount of ice on the evaporator 32, current environmental conditions (e.g., humidity), number of door openings, etc. can be used to select the initial defrost heater power control signal 44. During a first heating interval (e.g., interval A), the power supply 42 energizes the defrost heater at a first power level (step S1 in FIG. 6) according to the initial defrost heater power control signal 44. The controller 40 monitors the temperature signals 46, 47, 48 from the temperature sensors during the first heating interval (step S2). The controller 40 determines an evaporator temperature rise that occurs during the first heating interval from one or more of the temperature signals (step S3). The controller 40 then compares the rate of evaporator temperature rise during the first heating interval to the target rate of temperature rise for the first heating interval (step S4). Based on the results of the comparison, the controller adjusts defrost heater power control signal 44 so that the defrost heater 30 is operated at an adjusted power level during a subsequent second heating interval (e.g., interval B). For example, if the rate of evaporator temperature rise is greater than the target rate of temperature rise or exceeds a band of acceptable temperature rise (step S5), then the power level supplied to the defrost heater 30 is reduced (step S6). Conversely, if the rate of evaporator temperature rise is less than the target rate of temperature rise or is below a band of acceptable temperature rise (step S7), then the power level supplied to the defrost heater 30 is increased (step S8). If the rate of evaporator temperature rise meets the target rate temperature rise or is within an acceptable band, then the power level is maintained. The process can be repeated for any number of heating intervals. The defrosting operation can be stopped when the evaporator temperature reaches a predetermined final temperature or based on the ice detection signal (step S9).

The adjusted power level for a subsequent heating interval can be chosen based on the degree to which the rate of evaporator temperature rise deviates from the target rate. For example, if the power level for the first heating interval was medium M and the rate of evaporator temperature rise was much slower than the target rate, then the greater than rated power level Q could be chosen for the second heating interval. However, if the rate of evaporator temperature rise was only slightly slower than the target rate, then the high power level H could be chosen for the second heating interval.

Each heating interval can have its own target rate of temperature rise, or different intervals can use common target rates. Adjustments to the defrost heater power control signal 44 made by the controller 40 can be based on the rate of evaporator temperature rise during the immediately preceding interval or other preceding intervals.

The duration of a heating interval can be based on time, such as a fixed time. The duration of a heating interval can also be based on observing a change in the rate of evaporator temperature rise. For example, when ice melting occurs during the defrosting operation, the rate of evaporator temperature rise will decrease, which can be observed by the controller 40 and used as a transition point from one heating interval to another (e.g., first heating interval to second heating interval).

In an embodiment, the defrost heater 30 is operated at any one of a predetermined fixed number of different power levels. For example, as shown in FIG. 5, the different power levels can include a low power level L, a medium power level M, a high power level H, and a greater than rated power level Q. In other embodiments, the defrost heater 30 can be operated at many different power levels between 0% rated power and a power level greater than rated power.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A refrigeration appliance, comprising:

a storage compartment;

an evaporator that cools the storage compartment;

a defrost heater associated with the evaporator;

a temperature sensor that senses an evaporator temperature and generates a temperature signal based on the evaporator temperature;

a controller that receives the temperature signal and generates a defrost heater power control signal;

a memory that stores a predetermined first heating interval target temperature slope; and a power supply that receives the defrost heater power control signal and controls a power level supplied to the defrost heater based on the defrost heater power control signal, wherein a first power level is supplied to the defrost heater during a first heating interval of a defrosting operation, and the controller compares an evaporator temperature slope occurring during the first heating interval to the predetermined first heating interval target temperature slope and, based on an evaporator temperature rise occurring during the first heating interval, when the evaporator temperature slope occurring during the first heating interval is less than the predetermined first heating interval target temperature slope, the controller increases the defrost heater power control signal thereby increasing a heating level of the defrost heater during a second heating interval of the defrosting operation, and wherein the defrost heater is energized during the first heating interval and the second heating interval.

2. The refrigeration appliance of claim 1, wherein when the evaporator temperature slope occurring during the first heating interval is greater than the predetermined first heating interval target temperature slope, the controller reduces the defrost heater power control signal such that a reduced power level is supplied to the defrost heater during the second heating interval.

3. The refrigeration appliance of claim 2, wherein, based on at least one of the evaporator temperature rise occurring during the first heating interval and an evaporator temperature rise occurring during the second heating interval, the controller further adjusts the defrost heater power control signal such that a further adjusted power level is supplied to the defrost heater during a third heating interval of the defrosting operation subsequent to the second heating interval, wherein the defrost heater is energized during the third heating interval of the defrosting operation.

4. The refrigeration appliance of claim 1, wherein the defrost heater has a rated power, and at least one of the first power level and the adjusted power level is greater than the rated power.

5. The refrigeration appliance of claim 4, wherein the defrost heater is operated at any one of a predetermined fixed number of different power levels by the controller through the power supply, wherein the different power levels include a low power level, a medium power level, a high power level, and a greater than rated power level.

6. The refrigeration appliance of claim 1, further comprising an ice detector that senses an accumulation of ice on the evaporator and generates an ice signal, wherein the controller receives the ice signal and controls the defrosting operation based on the ice signal.

7. The refrigeration appliance of claim 1, further comprising additional temperature sensors that sense the evaporator temperature at respective different locations of the evaporator and provide respective temperature signals to the controller, wherein the controller controls the defrosting operation based on the respective temperature signals.

8. The refrigeration appliance of claim 7, wherein the defrost heater comprises a tubular electric resistance heating element surrounding the evaporator on three sides of the evaporator.

9. The refrigeration appliance of claim 1, wherein the power supply is a pulse-width modulated power supply.

10. A method of defrosting an evaporator of a refrigeration appliance, wherein the refrigeration appliance comprises a defrost heater associated with the evaporator, the method comprising the steps of:

energizing the defrost heater at a first power level;

monitoring an evaporator temperature during a first heating interval of a defrosting operation;

determining a rate of evaporator temperature rise occurring during the first heating interval;

providing a target rate of temperature rise for the first heating interval;

comparing the rate of evaporator temperature rise occurring during the first heating interval to the target rate of temperature rise for the first heating interval; and when the rate of evaporator temperature rise during the first heating interval is less than the target rate of temperature rise for the first heating interval, increasing the first power level to an adjusted, higher power level different from the first power level and operating the defrost heater at the adjusted, higher power level during a second heating interval of the defrosting operation, wherein the defrost heater is energized while operating at the adjusted, higher power level during the second heating interval of the defrosting operation.

11. The method of claim 10, wherein the target rate of temperature rise for the first heating interval comprises a predetermined target temperature slope.

12. The method of claim 10, further comprising the steps of:

determining a further adjusted power level for the defrost heater based on at least one of the rate of evaporator temperature rise during the first heating interval and a rate of evaporator temperature rise during the second heating interval; and operating the defrost heater at the further adjusted power level during a third heating interval of the defrosting operation subsequent to the second heating interval, wherein the defrost heater is energized during the third heating interval of the defrosting operation.

13. The method of claim 10, wherein the defrost heater has a rated power, and at least one of the first power level and the adjusted, higher power level is greater than the rated power.

14. The method of claim 13, wherein the defrost heater is operated at any one of a predetermined fixed number of different power levels, wherein the different power levels include a low power level, a medium power level, a high power level, and a greater than rated power level.

15. The method of claim 10, further comprising the steps of detecting an accumulation of ice on the evaporator, and starting the defrosting operation based on a result of the step of detecting.

16. The method of claim 10, wherein the step of monitoring the evaporator temperature includes monitoring evaporator temperatures at a plurality of different locations of the evaporator.

* * * * *